US005626070A

United States Patent [19]

Sorbel

[11] Patent Number: 5,626,070

[45] Date of Patent: May 6, 1997

[54] CONTROL LOGIC FOR A MULTIPLE USE HYDRAULIC SYSTEM

[75] Inventor: Dennis L. Sorbel, Maple Park, Ill.

[73] Assignee: Caterpillar Inc., Peoria, Ill.

[21] Appl. No.: 608,917

[22] Filed: Feb. 29, 1996

[51] Int. Cl.[6] ..... F15B 11/00

[52] U.S. Cl. ..... 91/521; 91/461; 91/459

[58] Field of Search ..... 91/461, 459, 521, 91/522

[56] References Cited

U.S. PATENT DOCUMENTS

| | | | |
|---|---|---|---|
| 4,133,251 | 1/1979 | Agge et al. | 91/521 |
| 5,014,596 | 5/1991 | St. Martin | 91/461 X |
| 5,081,905 | 1/1992 | Yagyu et al. | 91/461 |
| 5,102,102 | 4/1992 | Hidaka et al. | 91/461 X |
| 5,136,928 | 8/1992 | Hachisv | 91/459 X |
| 5,212,950 | 5/1993 | Shirai et al. | 91/461 X |
| 5,235,811 | 8/1993 | Arii et al. | 60/484 |

*Primary Examiner*—Hoang Nguyen
*Attorney, Agent, or Firm*—John W. Grant

[57] ABSTRACT

A control logic for a multiple use hydraulic system includes a selector switch having a first position connecting a battery to a treadle switch operable to energize a solenoid pilot valve for communicating pilot fluid to an end of a first directional control valve. The selector switch has another position connecting the battery to a bi-directional push button switch operable to selectively energize a pair of solenoids of a second pilot valve. Energizing one of the solenoids moves the second pilot valve in one direction to communicate pilot fluid to an end of the first and a second control valve. Energizing the other solenoid moves the second pilot valve in the opposite direction to communicate pilot fluid to the other end of the control valves. The selector switch has a third position connecting the battery to a pair of pressure switches connected to a pair of lines connecting a manually actuated pilot valve to a pair of solenoid blocker valves. Fluid pressure in either line will energize both blocker valves so that the manually actuated valve controls flow of pilot fluid to and from the opposite ends of the first control valve.

7 Claims, 1 Drawing Sheet

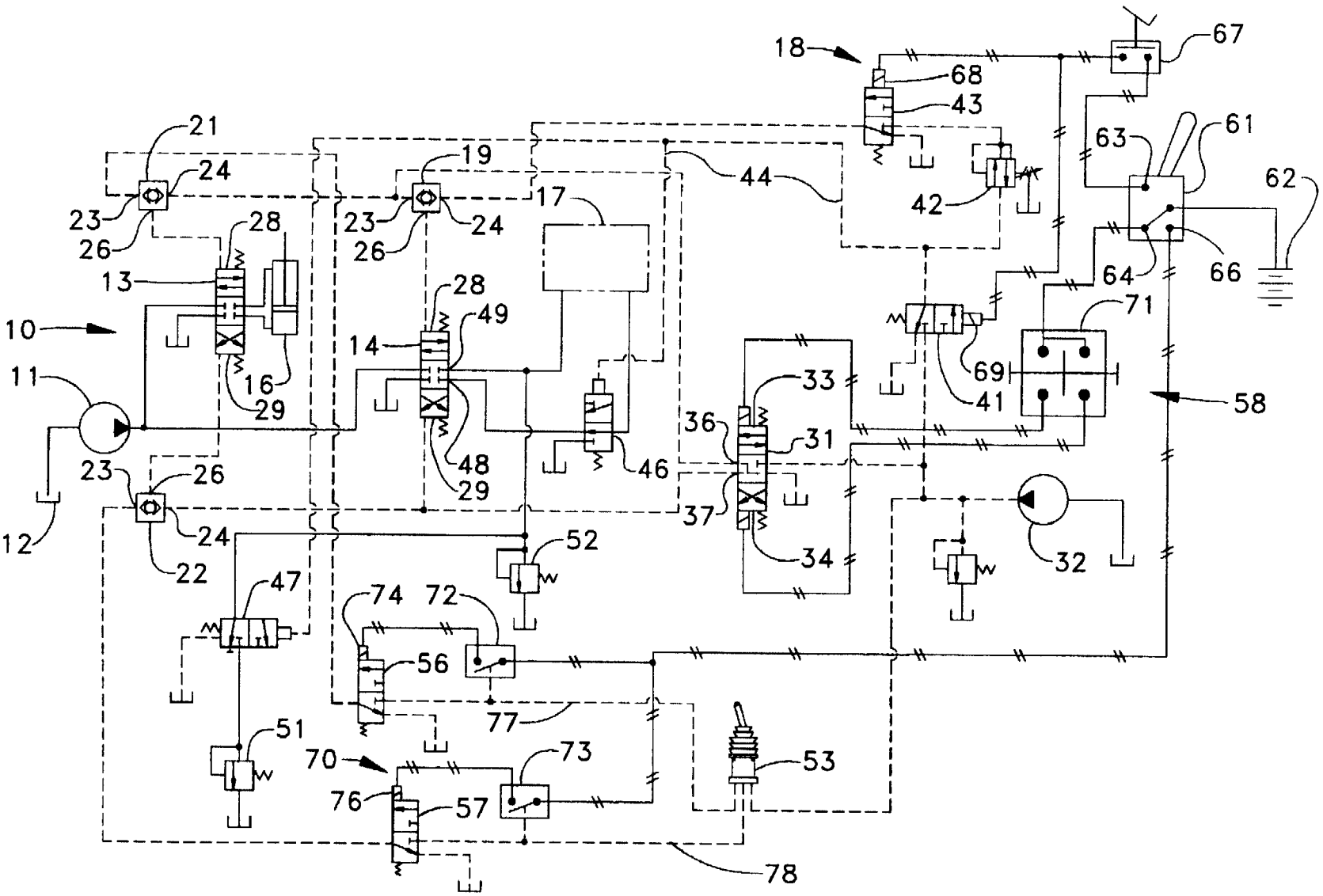
62
61
67
66
58
63
64
71
32
69
41
68
43
42
18
33
31
34
53
78
44
36
37
46
17
52
73
77
19
24
28
49
48
29
72
57
23
26
14
56
74
76
70
28
16
29
47
51
21
24
26
24
22
23
26
13
23
10
11
12

CONTROL LOGIC FOR A MULTIPLE USE HYDRAULIC SYSTEM

TECHNICAL FIELD

This invention relates generally to a hydraulic system and, more particularly, to a control logic that can be manually controlled to match the operating characteristics of the system to the particular work implement connected to the circuit.

BACKGROUND ART

Hydraulic excavators are very versatile machines and are readily adaptable to be fitted with one of many different types of hydraulically actuated work implements such as a conventional bucket, a hydraulic hammer, a shear, a grapple, and so forth. One of the problems encountered by the hydraulic excavator manufacturer is that each of the different types of work implements has different hydraulic requirements. For example, the operating position of a bucket is normally manually controlled and requires very precise metering of fluid flow to and from the hydraulic cylinder connected to the bucket for precise positioning of the bucket relative to the stick. On the other hand, a shear is normally hydraulically powered to the open or closed positions very quickly with only minimal or no metering of fluid flow to the shear actuator. A hydraulic hammer is normally driven continuously for some period of time such that the hydraulic requirement generally requires a fairly constant fluid flow with minimal operator intervention other than starting and stopping the hammer.

Thus, it is desirable to provide a hydraulic system readily adjustable to provide the hydraulic requirements for a variety of work implements and a control logic therefor to readily alter control of the hydraulic system to match the work implement requirements.

DISCLOSURE OF THE INVENTION

In one aspect of the present invention, a control logic for a multiple use hydraulic system having a tank, a supply pump and a pilot operated directional control valve connected to the tank and the supply pump and having first and second ends, the system being connectible to one of several hydraulically driven work implements. The control logic includes a resolver having an output connected to the first end of the control valve and first and second inputs, a solenoid actuated pilot valve connected to a pilot pump and having first and second solenoids at its opposite ends, a first control port connected to the first input of the resolver, and a second control port connected to the second end of the control valve. A second solenoid actuated pilot valve is connected to the pilot pump and to the second input of the resolver. A selector switch is connected to a source of electrical energy and has first and second poles, a first position connecting the source of electrical energy to the first pole and a second position connecting the source of electrical energy to the second pole. A first switch is connected to the first pole and to the solenoids of the second pilot valve. A second switch is connected to the second pole and to the solenoids of the first pilot valve and is operative to selectively connect the second pole to the first and second solenoids.

BRIEF DESCRIPTION OF THE DRAWINGS

The sole FIGURE is a schematic illustration of an embodiment of the present invention.

BEST MODE FOR CARRYING OUT THE INVENTION

A multiple use hydraulic system 10 includes a hydraulic supply pump 11 connected to a tank 12 and to a pair of pilot operated directional control valves 13, 14. A pair of hydraulic motors 16, 17 connected to the control valves represents the hydraulic actuators of conventional hydraulically actuated work implements having different operating characteristics. While the control valves are shown connected to two separate motors, they can alternatively both be connected to a common motor of the one work implement.

A control logic 18 is connected to the hydraulic system 10 and includes three resolvers 19, 21, 22 each having a pair of inputs 23, 24 and an output 26. The outputs of resolvers 21, 22 are connected to opposite ends 28, 29 of the control valve 13 and the output of the resolver 19 is connected to the end 28 of control valve 14. A three position, four way solenoid actuated pilot valve 31 is connected to a pilot pump 32 and has a pair of solenoids 33, 34 at its opposite ends, a control port 36 connected to the inputs 23 and 24 of the resolvers 19, 21 respectively and another control port 37 connected to the input 24 of the resolver 22 and to the end 29 of the control valve 14.

A two position, three way solenoid actuated pilot valve 41 and a variable setting pressure reducing valve 42 are serially disposed between the pilot pump 32 and a two position, three way solenoid actuated pilot valve 43 connected to the input 24 of the resolver 19. A pilot line 44 connecting the pilot valve 41 with the pressure reducing valve 42 is also connected to a pair of pilot operated valves 46, 47. The pilot valve 46 is connected to the hydraulic motor 17, the tank 12 and a control port 48 of the control valve 14. The pilot operated valve 47 is connected to another control port 49 of the control valve 14 and a low pressure relief valve 51. A high pressure relief valve 52 is also connected to the control port 49.

A manually actuated pilot control valve 53 is connected to the pilot pump 32, a solenoid actuated blocker valve valve 56 connected to the input 23 of the resolver 21 and a solenoid actuated blocker valve 57 connected to the input 23 of the resolver 24.

The logic control 18 also includes an electrical circuit 58 for controlling the solenoid actuated valves. The electrical circuit includes a three position selector switch 61 connected to a source of electrical energy such as a battery 62 and having three output poles 63, 64, 66. The pole 63 is connected to a treadle switch 67 which in turn is connected to a solenoid 68 of the pilot valve 43 and a solenoid 69 of the pilot valve 41. The second pole 64 is connected to a bi-directional push button switch 71 connected to the solenoids 33, 34 of the pilot valve 31. The pole 66 is connected to a pair of pressure switches 72, 73 connected to a solenoid 74 of the blocker valve 56 and a solenoid 76 of the blocker valve 57. The pressure switches 72, 73 are suitably connected to a pair of pilot lines 77, 78 connecting the pilot control valve 53 to the pilot valves 56, 57. The pressure switches constitute a means (70) for energizing the blocker valves when the selector switch is in the third position.

INDUSTRIAL APPLICABILITY

In one operating mode of the control logic, leftward movement of the push-button switch 71 when the selector switch 61 is in the position shown energizes the solenoid 33 thereby moving the pilot valve 31 downward. This directs fluid from the pilot pump 32 through the resolvers 19, 21 to the ends 28 to move both control valves 13, 14 downward.

Downward movement of the control valves simultaneously connects the pump 11 to the control ports 49 of both control valves. Conversely, rightward movement of the push-button switch 71 energizes the solenoid 34 moving the pilot valve 31 upward to direct pilot fluid to the ends 29 of the control valves. This moves both control valves upward to connect the pump 11 to the control ports 48 of both control valves. This operation is normally used when both control ports 49 are connected to only one of the fluid motors for faster operation thereof.

In another operating mode, the selector switch 61 is moved to connect the battery to pole 63 so that downward movement of the treadle switch 67 simultaneously energizes the solenoids 68, 69. Energizing the solenoid 69 moves the pilot valve leftward communicating fluid from the pilot pump 32 through the pressure reducing valve 42 and to the pilot valve 43. Energizing the solenoid 68 also moves the pilot valve 43 downward to thus communicate fluid passing through the pressure reducing valve 42 through the resolver 19 causing the control valve 14 to move downward to communicate fluid from the supply pump 11 to the motor 17 through the control port 49. Leftward movement of the pilot valve 41 also communicates fluid to the switching valve 46 moving it downward and to the switching valve 47 moving it leftward. Downward movement of the switching valve 46 communicates fluid exhausted from the motor 17 directly to the tank. The leftward movement of the switching valve 47 connects the control port 49 to the low pressure relief valve 51 which has a lower pressure setting than the high pressure relief valve 52. The pressure level of the pilot fluid directed to the control valve 14 is controllable by adjusting the pressure setting of the pressure reducing valve 42. Adjusting the pressure level controls the area opening of the control valve and thus the rate of flow to the motor 17. This operation is useful when the motor 17 is a hydraulic hammer normally operated for continuous periods at a selected speed.

In still another operating mode, moving the selector switch 61 connects the battery to the pole 66 to close the circuit to the pressure switches 72, 73. Thus, when the manually operated pilot valve 53 is moved clockwise, pressurized fluid is passed through the pilot line 77 to the blocker valve 56. When the pressure reaches a predetermined pressure level, the switch 72 closes to energize the solenoid 74 moving the blocker valves 56,57 downward. Downward movement of the blocker valves communicates fluid from the line 77 through the resolver 21 to move the control valve 13 downward and communicates fluid from the other end 29 through the resolver 22 to the pilot valve 53. Similarly, moving the pilot valve 53 counterclockwise directs pilot fluid through the pilot line 78 and ultimately through the resolver 22 to move the control valve 13 upward to another operating position. This operation permits precise control over the operating position of the control valve and is commonly utilized when the hydraulic motor connected to the control valve 13 requires precise positioning, for example, a bucket for an excavator.

In view of the above, it is readily apparent that the structure of the present invention provides an improved control logic for a multi-use hydraulic system for controlling a variety of hydraulically actuated work implements each having different operating characteristics. More specifically, the logic control has one operating mode in which only one of a pair of pilot operated directional control valves is operated, a second mode in which only the other control valve is operated or a third mode in which both control valves operate simultaneously dependent upon the type of work element connected to the hydraulic system. The logic control also provides varying types of manually operated controls to match those normally associated with the operational characteristic of the work element.

Other aspects, objects and advantages of this invention can be obtained from a study of the drawings, the disclosure and the appended claims.

I claim:

1. A control logic for a multiple use hydraulic system having a tank, a supply pump, a pilot pump, and a first pilot operated directional control valve connected to the tank and the supply pump and having first and second ends, the control logic comprising:

a resolver having an output connected to the first end of the control valve and first and second inputs;

a solenoid actuated first pilot valve connected to the pilot pump and having first and second solenoids at its opposite ends, a first control port connected to the first input of the resolver and a second control port connected to the second end of the control valve;

a solenoid actuated second pilot valve connected to the second input of the resolver;

a source of electrical energy;

a selector switch connected to the source of electrical energy and having first and second poles, a first position connecting the source of electrical energy to the first pole and a second position connecting the source of electrical energy to the second pole;

a first switch connected to the first pole and being operative to connect the first pole to the second pilot valve; and a second switch connected to the second pole and to the solenoids of the first pilot valve and being operative to selectively connect the second poles to the first and second solenoids.

2. The control logic of claim 1 including a second pilot operated directional control valve having first and second ends;

a second resolver having an output connected to the first end of the second control valve and first and second inputs, the first input being connected to the first control port of the first pilot valve;

a third resolver having an output connected to the second end of the second control valve, a first input connected to the second control port of the first pilot valve; and a manually actuated third pilot valve connected to the pilot pump and to the second inputs of the second and third resolvers.

3. The control logic of claim 2 wherein the the selector switch includes a third pole, and including a pair of solenoid actuated blocker valves disposed between the third pilot valve and the second inputs of the second and third resolvers, and means for energizing the blocker valves when the selector switch is in the third position.

4. The control logic of claim 3 including a pair of pilot lines connecting the third pilot valve to the blocker valves, the means including a pair of pressure switches connected to the pilot lines and to the third pole of the selector switch.

5. The control logic of claim 4 including a solenoid valve and a variable pressure reducing valve serially disposed between the pilot pump and the second pilot valve and having a solenoid connected to the first switch.

6. The control logic of claim 5 wherein the first control valve has a control port, a high pressure relief valve connected to the control port and a pilot operated switching valve and a low pressure relief valve serially disposed between the control port and the tank, the switching valve being connected to the solenoid valve.

7. The logic control of claim 6 wherein the first control valve has another control port and including another pilot operated switching valve connected to the other control port.

* * * * *